US006779631B1

(12) United States Patent
Hensley et al.

(10) Patent No.: US 6,779,631 B1
(45) Date of Patent: Aug. 24, 2004

(54) SCAFFOLD PICK-UP DEVICE

(75) Inventors: Ken Hensley, St. Amant, LA (US); Yates Westley Hayman, Walker, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 0 days.

(21) Appl. No.: 09/892,381

(22) Filed: Jun. 26, 2001

Related U.S. Application Data

(60) Provisional application No. 60/214,814, filed on Jun. 28, 2000.

(51) Int. Cl.[7] ..... E04G 7/00; E04G 1/00; E04G 3/00

(52) U.S. Cl. ..... 182/178.1; 182/129; 248/228.4; 248/230.4

(58) Field of Search ..... 182/129, 178.1, 182/179.1, 178.5, 178.6; 403/49, 246; 248/227.3, 228.4, 228.5, 230.4, 230.5, 231.51, 231.01

(56) References Cited

U.S. PATENT DOCUMENTS 1,243,388 A * 10/1917 Corley ..... 248/228.5 X
1,547,065 A * 7/1925 Noble ..... 248/230.4 X
1,547,915 A * 7/1925 Hirn ..... 248/230.5 X
2,665,950 A * 1/1954 Johnson ..... 182/179.1 X
3,684,058 A * 8/1972 Brown ..... 182/178.1 X
4,090,798 A 5/1978 Barton ..... 403/171
4,273,463 A 6/1981 Dobersch ..... 403/246
4,445,307 A 5/1984 Puccinelli et al. ..... 52/638
4,452,337 A * 6/1984 Atzinger ..... 182/178.1
5,028,164 A 7/1991 Williams ..... 403/246
5,078,532 A 1/1992 Williams ..... 403/246
5,615,968 A * 4/1997 Verenski et al. ..... 182/179.1 X
6,152,263 A * 11/2000 Van Oers et al. ..... 182/179.1
6,305,868 B1 * 10/2001 Kinoshita et al. ..... 403/49
6,354,402 B1 * 3/2002 Masino ..... 182/178.1 X

* cited by examiner

*Primary Examiner*—Hugh B. Thompson, II
(74) *Attorney, Agent, or Firm*—Jones, Walker, Waechter, Poitevent, Carrere & Denegre, LLP

(57) ABSTRACT

A scaffold pick-up device having a vertical joint clamp which bridges a vertical scaffold joint to stiffen the bridged vertical joint, and a scaffold lift assembly, which attaches onto the top section of a vertical scaffold member and has an attachment point for a shackle or other lifting gear.

9 Claims, 7 Drawing Sheets

SCAFFOLD PICK-UP DEVICE

Priority Claim: This application claims the priority benefit of United States provisional application number 60/214,814, filed on Jun. 28, 2000.

FIELD OF INVENTION

This invention relates to scaffold structures, and in particular, to devices for lifting scaffold structures without disassembling.

BACKGROUND OF THE INVENTION

Scaffold structures consists of horizontal and vertical scaffold members joined together to form a scaffold frame. Scaffold members are assembled to form the suitable desired structure. In construction, to create tall scaffold structures, several vertical members may have to be combined, and the location where vertical members are combined is called a "joint." To create a broad frame, several horizontal members may have to be combined. Horizontal members are usually joined by combining with a vertical member. Construction is done by hand assembly, and can be assisted with cranes and other lifting equipment. However, lifting equipment is generally used to lift the various members (vertical and horizontal) to the location where assembly is ongoing.

In some sites, assembly is difficult as the assembly site is obstructed or the confines are restricted, such as by other buildings, construction equipment, etc. At these type of sites, it is desirable to assemble the scaffold structure in a location where space is unrestricted, remote from the actual use location, and move the assembled frame into position, such as by a rollers or casters. At other sites, the same scaffold structure may have to be duplicated for re-use at many locations, and it would be convenient to be able to move an assembled structure from place to place without the need to assemble or disassemble the structure.

Prior methods for moving an assembled scaffold structure were by rollers or casters placed upon the bottom of the vertical members. While efficient for relatively small scaffold structures, such means are cumbersome for larger structures.

It is generally not considered useful to lift assembled scaffold structures as the structures flex vertical scaffold joints (for tall structures) and at horizontal scaffold joints (for broad structures). In scaffold structures where joints are not restricted to prevent upward movement, lifting is not possible—the assembled frame would disassemble by lifting.

SUMMARY OF THE INVENTION.

It is an object of the invention to provide a scaffold pick-up device that allows an assembled scaffold structure to be moved from one location to another without the need for disassembly and reassembly.

It is another object of the invention to provide a scaffold pick-up device that allows a scaffold frame to be assembled in sections, and the individual sections picked up for assembly with other sections.

It is an object of the invention to provide a vertical joint stiffener to prevent flexing of vertical scaffold joints in movement of the scaffold frame.

According, a scaffold pickup device is disclosed. The device includes a joint clamp which bridges a vertical scaffold joint to stiffen the bridged vertical joint, and a scaffold lift assembly, which attaches onto the top section of a vertical scaffold member and has an attachment point for a shackle or other lifting gear.

DETAILED DESCRIPTION OF THE PREFERRED EMBODIMENT

The present invention is intended for use in a scaffold system having vertical and horizontal support members, where horizontal members are locked or coupled into vertical members. By "locked" is meant that when a horizontal member is "locked" with a vertical member, the horizontal member is engaged or coupled with the vertical member in a fashion to resist the horizontal member from disengaging with the vertical member. The locking mechanism can result in a rigid joint between the horizontal and vertical members, such as shown in U.S. Pat. No. 4,445,307 to Puccinelli (incorporated by reference), or a semi flexible joint, as shown in U.S. Pat. No. 5,078,532 or U.S. Pat. No. 5,028,164 to Williams (incorporated by reference). In general, the lock is created by engaging the horizontal member onto the vertical member, and the point of engagement generally is at a protrusion on the vertical member, such as a protruding cup (Puccinelli or Williams), a protruding annulus (U.S. Pat. No. 4,273,463 to Dobersch) (incorporated by reference), a thickening of the vertical member near the area of the joint (U.S. Pat. No. 4,090,798 to Barton) (incorporated by reference), or other protrusion on the vertical member. The protrusions on the vertical member are used by the pick-up device to link stacked vertical members together to prevent disengagement during a lifting operation. While the pickup device can be used with structures where horizontal members are not locked to the vertical members, it is not recommended, as the risk of accidental disassembly during lifting is greater when such locking (or coupling) is lacking.

Figure 1A:
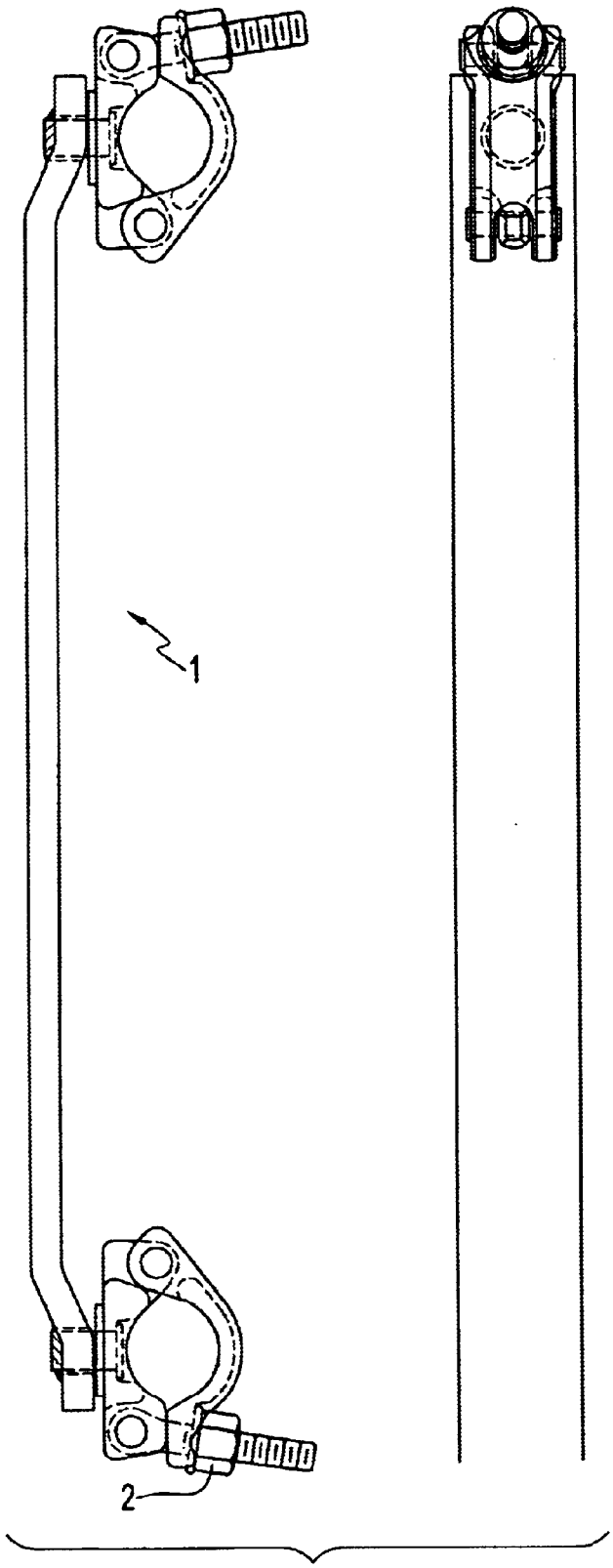
FIG. 1*a* is a perspective view of one embodiment of a vertical scaffold joint clamp.

The device generally consists of two pieces: (1) vertical scaffold joint clamp and (2) a scaffold lift assembly. The vertical scaffold joint clamp (the "clamp") is a clamp means for bridging a vertical scaffold joint. A vertical scaffold joint is a joint where two vertical scaffold members meet, thereby allowing a scaffold structure to be built upwardly. Shown in FIG. 1 is such a joint of two vertical members 100 and 200.

Figure 1B:
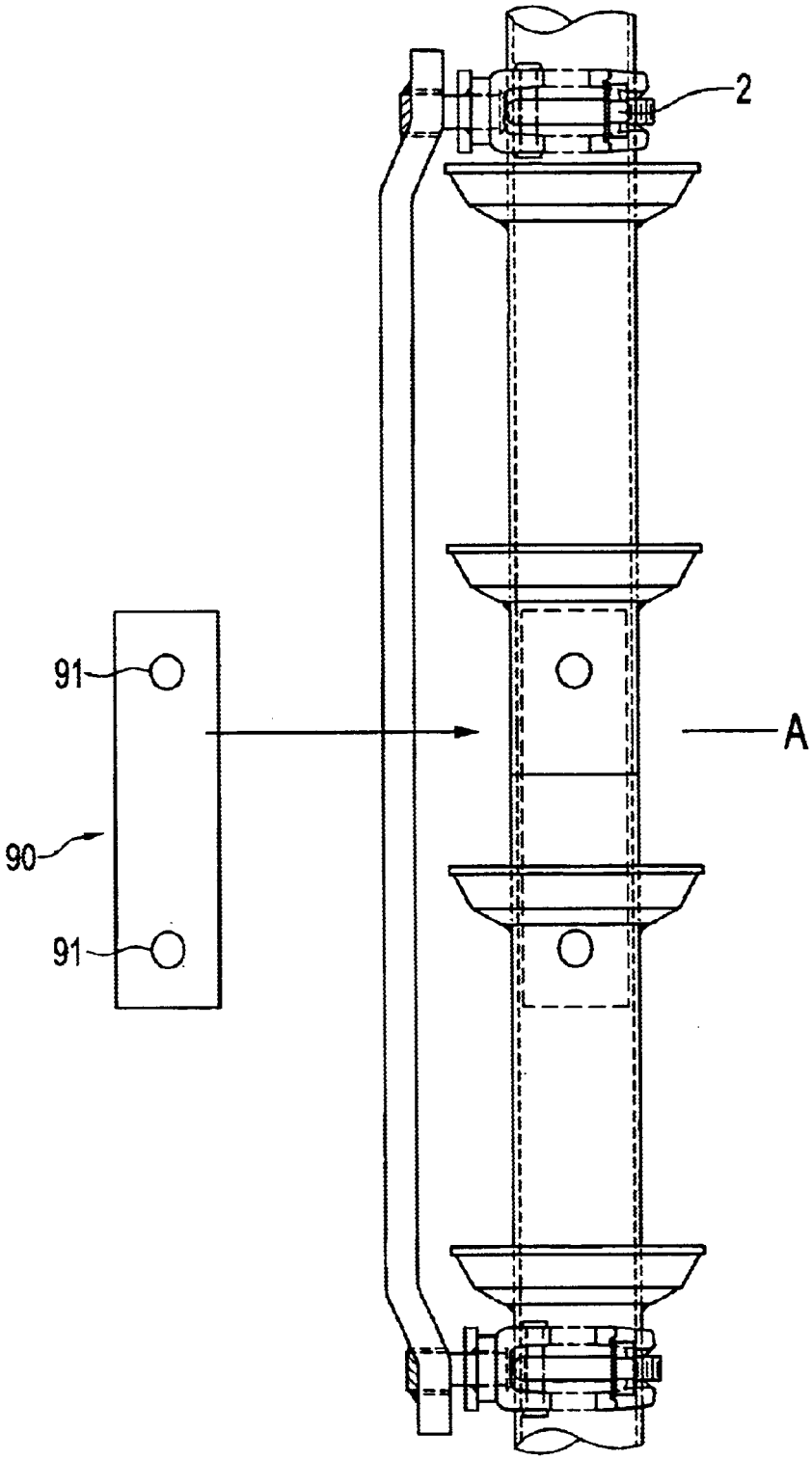
FIG. 1*b* shows the embodiment of FIG. 1*a* installed on a vertical scaffold joint clamp.
Figure 1C:
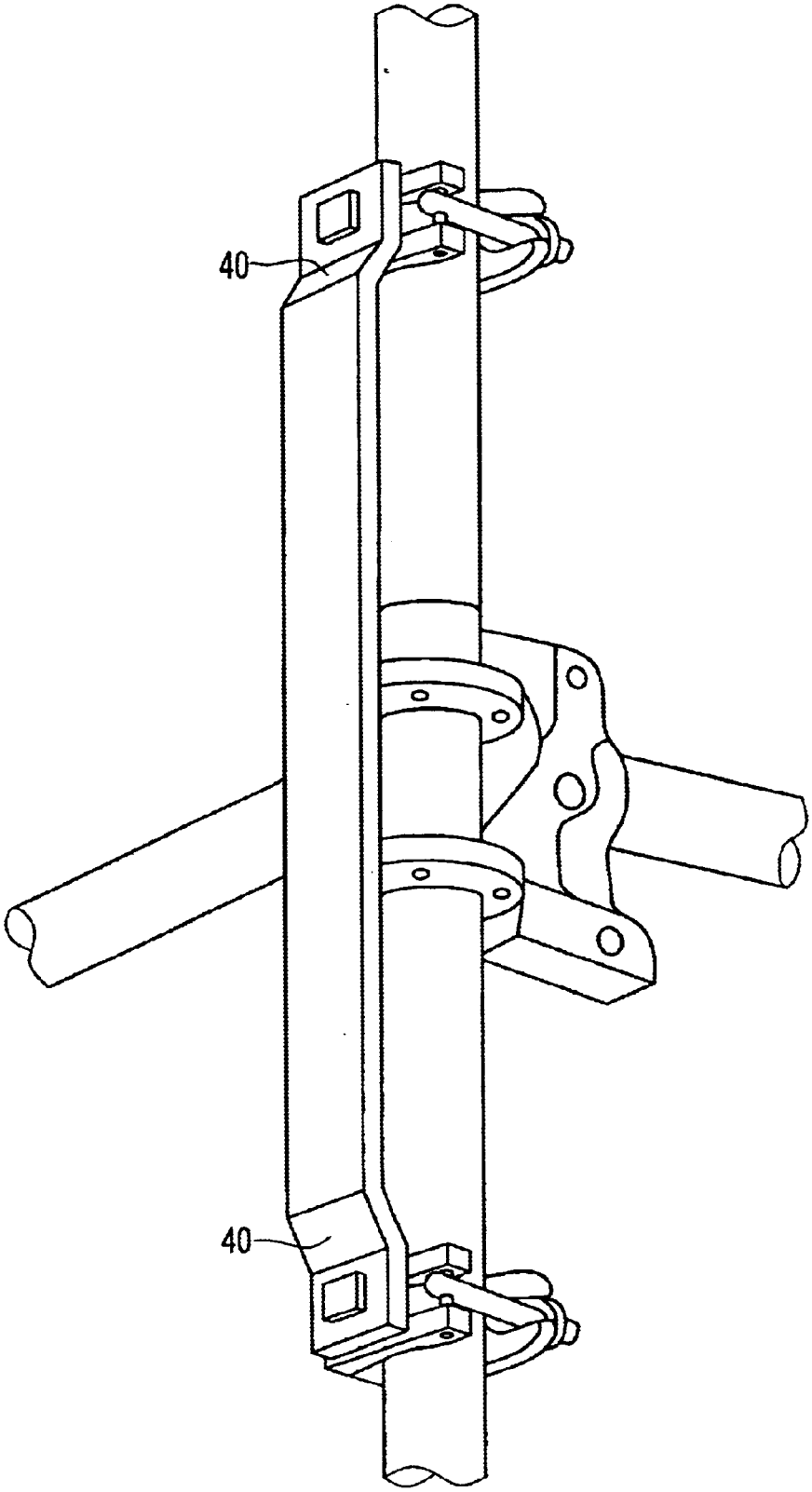
FIG. 1*c* shows the embodiment of FIG. 1*a* installed on a vertical scaffold joint clamp.

One of the simplest clamps is also shown in FIG. 1. The clamp is a plate or bar 1 with two connectors 2, one at each end of the bar 1. At least one of the connectors 2 should releasingly engage a vertical scaffold member (as shown, both connectors are releasingly engagable). The clamp is shown in place and bridging a vertical scaffold joint "A" in FIG. 1*b*, and couples to the vertical member, by clamping under cups on the vertical members. Note that the clamps are placed on the ends of the bar at indents 40. The indents are sized to allow the bar be set back from the vertical scaffold member to allow the bar to pass over intervening protrusions between the clamps, as shown in FIG. 1*c*.

Note that generally, the vertical joint will be locked in place by a releasable latch, or other device (such as a sleeve 90 insertable into the interior of the vertical members with buttons 91on the sleeve which engage with openings in the vertical members, as detailed in FIG. 1*b*). This type of "means to lock the vertical members together" is generally not designed to support the weight of a portion of the scaffold structure, such as would occur during lifting of an assembled structure. For this reason, the clamp is designed to bridge across a scaffold joint, whereby, in picking up a scaffold structure, the weight of the structure is transferred, by action of the clamp, to the cups (or other protrusion on the vertical member) above and/or below the joint (shown in FIG. 1*a*) or to the vertical member itself, above and below the joint (see FIG. 1*c*). While it is possible to use just the scaffold pick-up assembly to lift a scaffold structure in conjunction with the existing vertical scaffold joint lock (when present), it is not recommended.

Figure 2A:
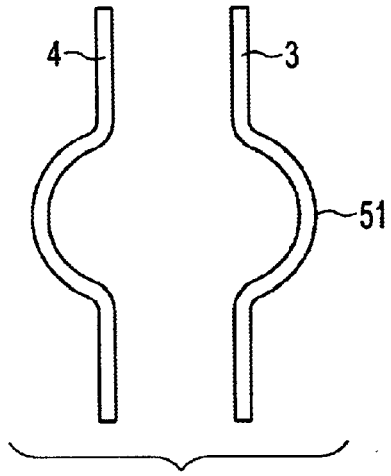
FIG. 2*a* is a top perspective view of another embodiment of a vertical scaffold joint clamp.
Figure 2B:
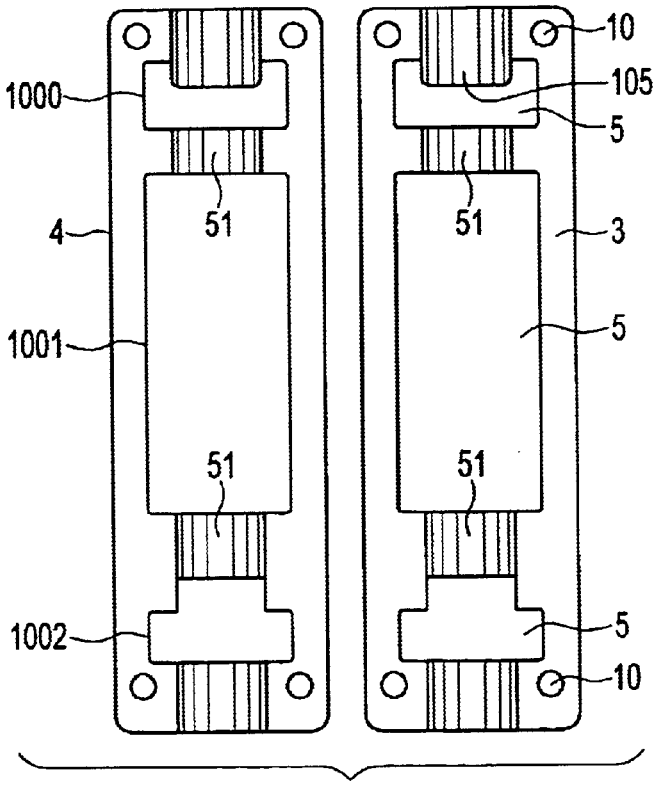
FIG. 2*b* is a side perspective view of vertical scaffold joint clamp of FIG. 2*a*.
Figure 3:
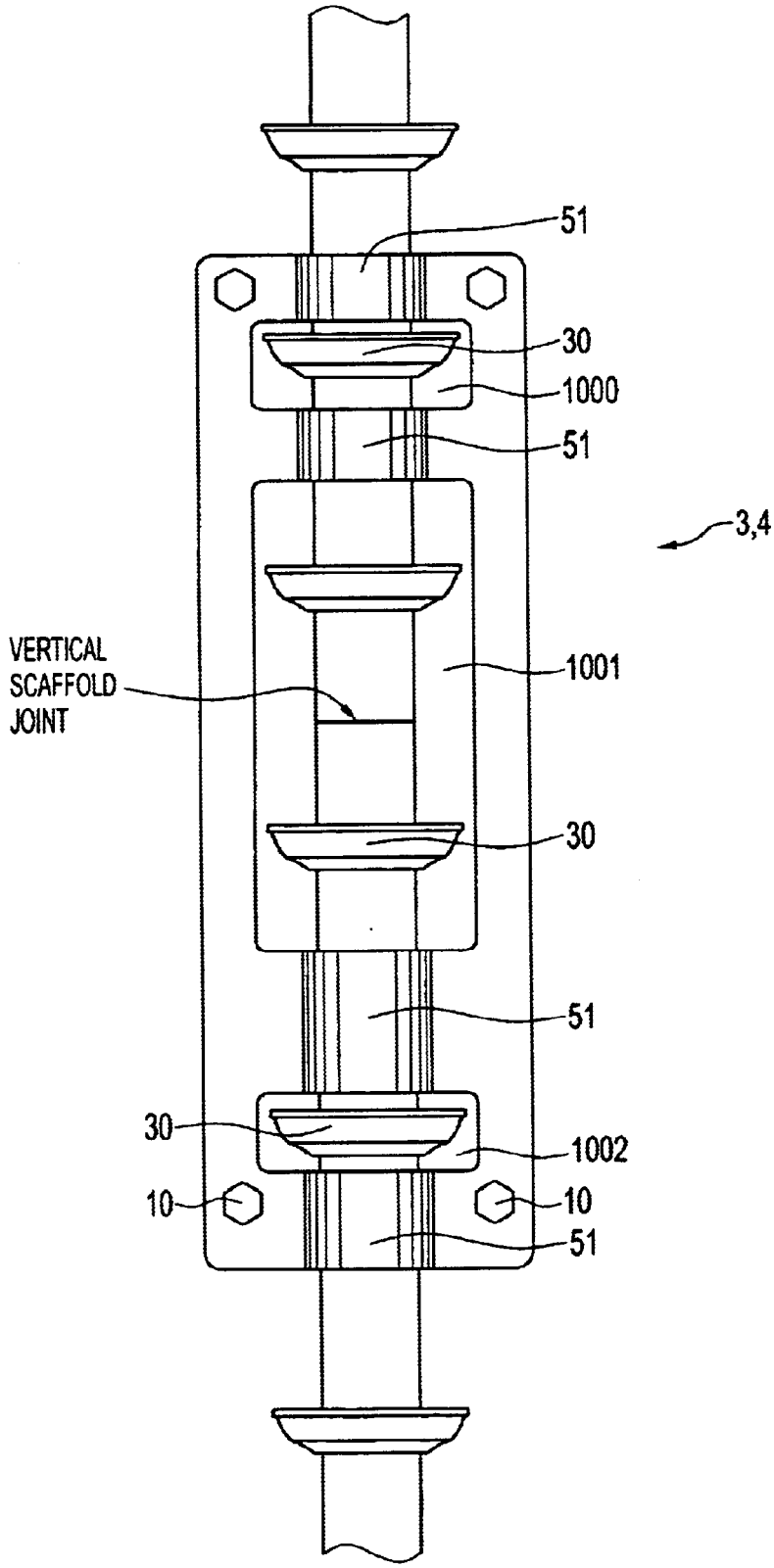
FIG. 3 shows the vertical scaffold joint clamp of FIG. 2*a* installed on a vertical scaffold joint.

Another embodiment of a clamp is shown in FIG. 2A, 2B and 2C. In these figures, the clamp is two generally flat plates 3 and 4, having openings 5 to accommodate the protrusions created on the vertical member. As shown in FIG. 2, the openings are designed to allow the protrusions (shown as scaffold cups) to pass through the openings. Shown on the clamp are three openings, 1000, 1001 and 1002. The center opening simply bridges across two cups nearest to scaffold joint and, in a lifting operation, would not support any weight. Opening 1000 and 1002 bridge across cups remote from the vertical joint and the metal forming these openings would transfer the frame weight in a lifting operation to the adjacent protrusions or cups. Note the top opening 1000 has a nose section 105. The nose section is designed to engage the inside of a scaffold cup 30 (shown in FIG. 2C) when a lifting force is placed on the vertical member. Bottom opening 1002, in a lifting operation would contact the bottom of a cup and transfer the lifting forces to the cup. It is not necessary that the clamp have the center opening; instead, the clamp may join adjacent to the two cups closest to the vertical joint.

Both above and below the openings, the clamp or connector has semi-circular sections 51 designed to contact the vertical scaffold member. Each plate is placed adjacent a vertical scaffold joint, and joined together, in the embodiment shown, by bolts through boltholes 10. The clamp thus creates a substantially rigid frame about the vertical scaffold joint. The semicircular sections, when the plates are joined, substantially encircle the vertical scaffold member. A disadvantage of the clamp in FIG. 2 is that this clamp cannot be installed over an existing location where horizontal/vertical members are joined without disassembly. Consequently, if the scaffold is to be moved, this types of clamp is best installed while the frame is being assembled. The clamp shown in FIG. 1 can be installed after assembly.

For purposes of discussion, consider the case where the scaffold structure has two layers of vertical members, hence, the structure has a single layer of vertical scaffold joints joined by the clamp in FIG. 1. An upward force on the top vertical scaffold member (to pick up the structure) may result in the upper connector sliding on the uppermost vertical scaffold member. However, the clamp connector will only slide a certain distance before contacting a cup. Once a cup is contacted, the clamp moves in unison with the uppermost scaffold member. Upon further upward movement, the lower connector may slide on the lowermost vertical scaffold member; again, the clamp will only side a given distance on the lower vertical scaffold member before the lower connector contacts a cup. At this point, the two layers of vertical scaffold members will move in unison. Because the clamp rigidly bridges the two vertical layers, the two layers (once contact between the connectors and cups) will be coupled and move upwardly in unison.

With the present device, the scaffold structure is designed to be lifted by applying a lifting force on the vertical members. For this reason, it is necessary that the horizontal members be locked or coupled into the vertical members and thereby prevent the structure from falling apart when the structure is lifted. If the horizontal members are rigidly locked into the vertical member, the structure, in lifting, will experience minor racking. If the horizontal/vertical lock is not a rigid joint, the structure will experience more racking, and care should be taken to diagonally brace the structure, particularly along the outer perimeter, to evenly spread the lifting forces on the comers of the structure to minimize racking forces during lifting.

The device also includes a means for coupling to a lifting device. The means for coupling is simply a device, or lift couple, attached at or near the top of a vertical member to which a lifting force can be easily applied, for instance, as by a crane. A simple lift couple device could be an adaptation of the clamps. For instance, the lift couple could be a bar with a single connector at one end of the bar and an opening in the bar above the connector. The bar would be attached to the uppermost vertical member so that the connector is below a cup or other protrusion, and the lifting accomplished by attaching a rope, shackle, chain, link, cable, hook or other such linking device through the opening for attachment to the lifting harness of the crane or hoist. The opening operates as a means for coupling a lift cable. Obviously, instead of an opening, the lift couple could have a link, shackle, chain or other such linking device attached to the bar.

Another lift couple is show in FIG. 4 as two matching plates 10, having three openings, 10*a*, 10*b*, and 10*c*. Opening 10*a* and 10*b* are designed to allow placement of the plates around cups on the uppermost vertical member, as show in FIG. 4*b*. The lift couple has semicircular shaped sections 10*d* to embrace around a vertical member, shown in cross section in FIG. 4*c*. Opening 10*c* is an attachment point for a shackle, cable, etc. Obviously opening does not have to be above the vertical member as shown, although such an arrangement is preferred to help evenly distribute the lifting forces. Again, instead of an opening, the lift couple could include a link, shackle, chain or other such linking device coupled to one or both plates.

Figure 4A:
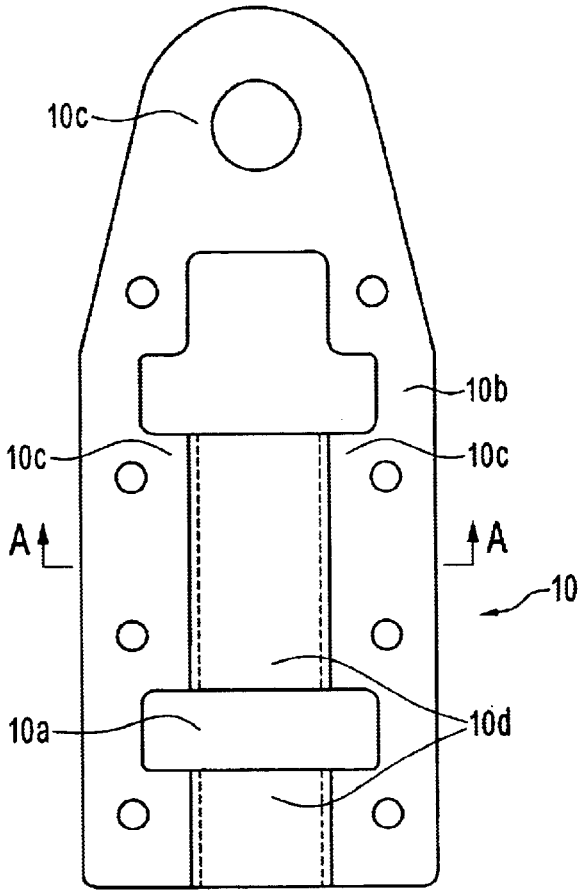
FIG. 4*a* is a front isometric view of the one embodiment of a scaffold lift couple.
Figure 4C:
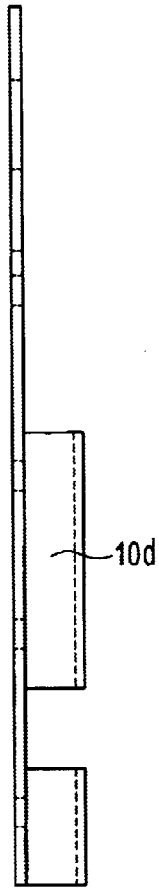
FIG. 4*c* shows the lift couple of FIG. 4*a* attached to a vertical scaffold member.
Figure 4B:
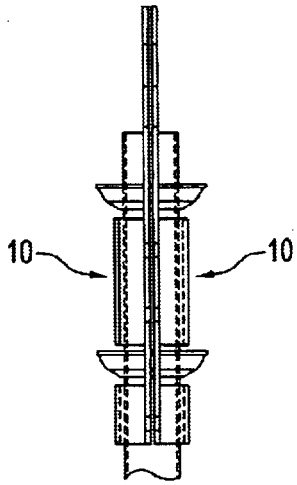
FIG. 4*b* is a side isometric view of the lift couple of FIG. 4*a*.
Figure 4D:
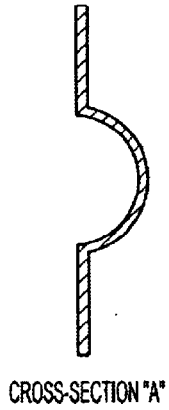
FIG. 4*d* shows a cross-section, at location A—A, of the lift couple shown in FIG. 4*a*.

As shown in FIG. 4*b*, the two plates 10 of the lift couple are joined around a scaffold vertical member and bolted through openings 10*e* in the plates 10. Again, this particular lift couple allows forces to be transferred to the two uppermost cups through openings 10*a* and 10*b*. A single opening engaging a single cup could be used, but is not preferred, as two opening provides redundancy as a safety precaution.

Figure 5:
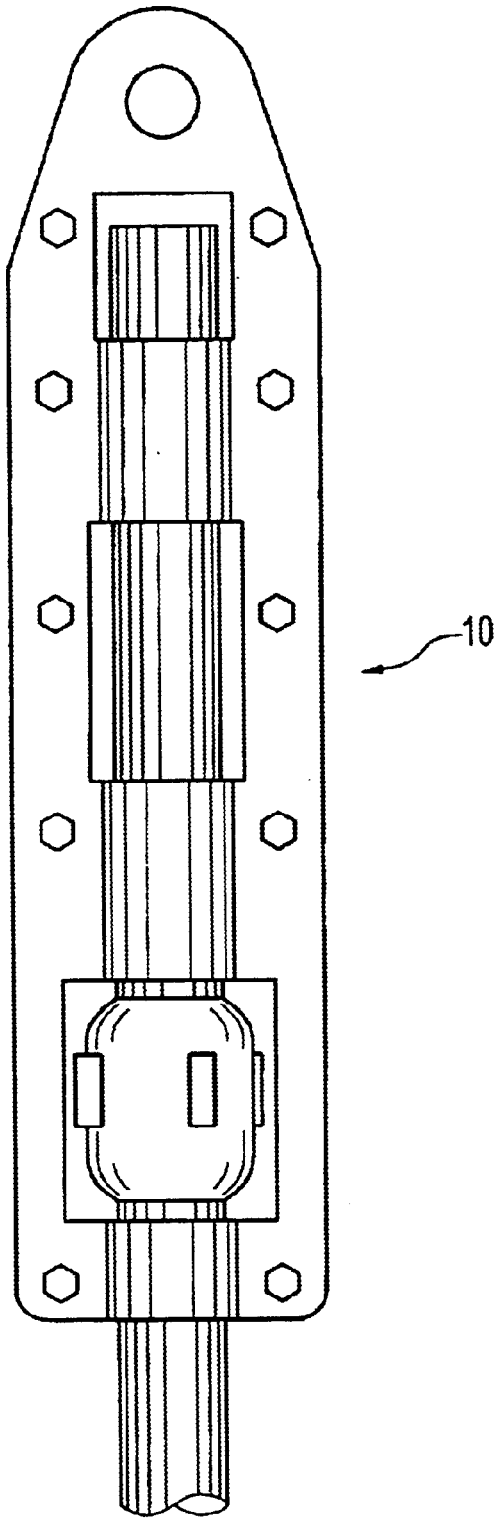
FIG. 5 is an isometric view of another embodiment of a lift couple.

Obviously, the location and number of openings in the lift couple will depend upon the geometry of the vertical scaffold members. FIG. 5 shows another embodiment of the lift assembly for attachment to another type of vertical scaffold member. Again, the lift assembly is two plates bolted together. This lift couple only has a single opening (the lowermost) which interacts with a scaffold member protrusion. The uppermost opening, again, is designed as an attachment point for a shackle, cable, etc. The middle opening is there simply to remove metal in order to reduce the weight of the lift couple.

We claim:

1. A scaffold lift mechanism for use in lifting a scaffold frame having vertical scaffold members coupled to horizontal scaffold members, comprising a clamp means for bridging a vertical scaffold joint and a means for coupling a vertical scaffold member to a lifting device.

2. The scaffold lift mechanism according to claim 1 where the clamp means is a bar having first and second ends, and first and second clamps positioned on said bar respectively near said first and said second ends, said clamps being removably clampable to a vertical scaffold member.

3. The scaffold lift mechanism according to claim 1 where said means for coupling a vertical scaffold member to a lifting device comprises at least one plate having an opening therethrough, said plate being adapted for embracing a top portion of a vertical scaffold member, said adaptation being that said plate is semicircular in cross section near the area of contact with a vertical scaffold member, said plate further having a means for attaching a lift cable.

4. The scaffold lift mechanism according to claim 3 where said means for attaching a lift cable includes a second opening on said plate.

5. The combination of a scaffold lifting device and a scaffold frame, said scaffold frame comprising vertical members coupled to horizontal members, said vertical members having protrusions thereon where said coupling between said vertical members and said horizontal members may take place, said scaffold lift mechanism comprising a clamp means for bridging a vertical scaffold joint and a means for coupling a vertical scaffold member to a lifting device.

6. The combination according to claim 5 where the clamp means is a bar having first and second ends, and first and second clamps positioned on said bar respectively near said first and said second ends, said clamps being removably clampable to said vertical members.

7. The combination according to claim 5 where said means for coupling a vertical scaffold member to a lifting device comprises at least one plate having an opening therethrough, said plate being adapted for embracing a top portion of one of said vertical members, said adaptation being that said plate is semicircular in cross section near the area of embracement, said plate further having a means for attaching a lift cable.

8. The combination according to claim 7 where said means for attaching a lift cable includes a second opening on said plate.

9. The combination according to claim 5 where said protrusions on said vertical members are cups.

* * * * *